US010475634B2

(12) United States Patent
Yu et al.

(10) Patent No.: US 10,475,634 B2
(45) Date of Patent: Nov. 12, 2019

(54) VACUUM ELECTRO-SPRAY ION SOURCE AND MASS SPECTROMETER

(71) Applicant: Graduate School at Shenzhen, Tsinghua University, Shenzhen, Guangdong (CN)

(72) Inventors: Quan Yu, Guangdong (CN); Qian Zhang, Guangdong (CN); Xiaohao Wang, Guangdong (CN); Xiang Qian, Guangdong (CN); Kai Ni, Guangdong (CN)

(73) Assignee: Graduate School at Shenzhen, Tsinghua University, Shenzhen, Guangdong (CN)

( * ) Notice: Subject to any disclaimer, the term of this patent is extended or adjusted under 35 U.S.C. 154(b) by 0 days.

(21) Appl. No.: 15/981,490

(22) Filed: May 16, 2018

(65) Prior Publication Data

US 2018/0301328 A1 Oct. 18, 2018

Related U.S. Application Data

(63) Continuation of application No. PCT/CN2017/085721, filed on May 24, 2017.

(30) Foreign Application Priority Data

Apr. 12, 2017 (CN) ..... 2017 1 0237631

(51) Int. Cl.
*H01J 49/16* (2006.01)
*H01J 49/04* (2006.01)

(52) U.S. Cl.
CPC ..... *H01J 49/167* (2013.01); *H01J 49/0404* (2013.01); *H01J 49/045* (2013.01); (Continued)

(58) Field of Classification Search
CPC ..... H01J 49/167; H01J 49/165; H01J 49/404; H01J 49/0431; H01J 49/045; H01J 49/0495
See application file for complete search history.

(56) References Cited

U.S. PATENT DOCUMENTS 5,542,828 A * 8/1996 Grenci ..... F04C 23/006 417/201
5,652,427 A * 7/1997 Whitehouse ..... H01J 49/0481 250/282

(Continued)

FOREIGN PATENT DOCUMENTS

CN 201975366 U 9/2011
CN 102339720 A 2/2012

(Continued)

OTHER PUBLICATIONS

International Search Report and Written Opinion issued in PCT/CN2017/085721, dated Jan. 11, 2018.
Office Action issued in CN201710237631.9, dated Mar. 26, 2018.

*Primary Examiner* — David E Smith
(74) *Attorney, Agent, or Firm* — Hamre, Schumann, Mueller & Larson, P.C.

(57) ABSTRACT

The vacuum electro-spray ion source comprises a hollow capillary, a vacuum cavity, a gas inlet pipe, a gas supply device and an adjusting device, wherein a first end of the hollow capillary is a sampling port, and a second end is used as a spray nozzle for vacuum electro-sprays and stretches into the vacuum cavity; the air pressure in the vacuum cavity is ranged from 10 to 200 Pa; one end of the gas inlet pipe stretches into the vacuum cavity, and the other end is connected with the gas supply device; and the adjusting device is configured for adjusting the gas inlet pipe to allow the gas to flow therein intermittently. The ion source may achieve electro-spray ionization in the vacuum environment, so that losses during ion transmission may be reduced to improve the signal intensity and detection limit during detection.

8 Claims, 2 Drawing Sheets

(52) U.S. Cl.
CPC ..... *H01J 49/0431* (2013.01); *H01J 49/0495* (2013.01); *H01J 49/165* (2013.01)

(56) References Cited

U.S. PATENT DOCUMENTS

| | | | | | |
|---|---|---|---|---|---|
| 5,672,868 | A * | 9/1997 | Mordehai | H01J 49/0445 | 250/281 |
| 6,068,749 | A * | 5/2000 | Karger | G01N 27/44717 | 204/451 |
| 7,312,441 | B2 * | 12/2007 | Land | H01J 49/40 | 250/282 |
| 7,312,444 | B1 * | 12/2007 | Willougbhy | H01J 49/065 | 250/288 |
| 8,604,424 | B2 * | 12/2013 | Amirav | H01J 49/0431 | 250/281 |
| 9,242,258 | B2 | 1/2016 | Brekenfeld et al. | | |
| 2005/0061673 | A1 * | 3/2005 | Presto Elgstoen | H01J 49/04 | 204/601 |

FOREIGN PATENT DOCUMENTS

| | | | |
|---|---|---|---|
| CN | 102709147 | A | 10/2012 |
| CN | 103545166 | A | 1/2014 |
| CN | 106198707 | A | 12/2016 |

* cited by examiner

VACUUM ELECTRO-SPRAY ION SOURCE AND MASS SPECTROMETER

CROSS REFERENCE TO RELATED APPLICATION

This application is a continuation application of PCT/CN2017/085721, filed on May 24, 2017. The contents of PCT/CN2017/085721 are all hereby incorporated by reference.

TECHNICAL FIELD

The present application relates to the field of analytical instrument, and in particular, to a vacuum electro-spray ion source and a mass spectrometer.

BACKGROUND

Mass spectrometry, one of the most widely applied analytical techniques, has characteristics of high sensitivity, great accuracy, rapid analysis speed and strong qualitative capabilities. In order to meet the urgent demands of the on-the-spot real-time analysis and the online rapid detection and analysis, it is of great importance to develop miniaturized and portable mass spectrometers.

Traditional electro-spray ion sources are simple in structure, and their working process may be simply described as follows: a sample solution is made to flow through a capillary at a slow flow rate; the capillary is connected with a high voltage, and whether this voltage is positive or negative depends on the property of an analyte; the voltage provides an electric field gradient required by separation of charges on the liquid surface; under the action of the electric field, the liquid forms a "Taylor cone" at the capillary tip; when the solution at the tip of the Taylor cone reaches the Rayleigh limit, namely the critical point where the Coulomb repulsion of surface charges is equivalent to the surface tension of the solution, droplets containing large quantities of charges will be generated at the cone tip; with the evaporation of solvents, the droplets shrink, and repulsion among charges within the droplets increases; when this repulsion reaches and exceeds the Rayleigh limit, the droplets will undergo a Coulomb explosion to remove excess charges on their surfaces and to generate smaller charged droplets; the generated smaller charged droplets further undergo another explosion, and this process repeats again and again; eventually, gas-phase ions are obtained, and finally detected by a mass analyzer.

As for traditional electro-spray ion sources, gas-phase ions are generated in the atmospheric environment, which are then transmitted, via a sample introduction device, into the vacuum cavity where they are detected by the mass analyzer. In this process, losses of ions occur during their transmission, which restricts the signal intensity and detection limit of the analyte. Therefore, there is a wide application prospect of developing a simple vacuum electro-spray ion source that is featured by a simplified instrument structure and capable of reducing ion losses and improving the signal intensity and detection limit of a detected substance.

SUMMARY

The technical problem to be actually solved by the embodiments of the present application is to remedy the foregoing deficiencies in the prior art, and provide a vacuum electro-spray ion source and a mass spectrometer that are capable of reducing losses during ion transmission and improving the signal intensity and detection limit during detection.

The technical problem faced by the embodiments of the present application is solved via the following technical solution:

a vacuum electro-spray ion source, comprising: a hollow capillary, a vacuum cavity, a gas inlet pipe, a gas supply device and an adjusting device, wherein a first end of the hollow capillary is a sampling port, and a second end is used as a spray nozzle for vacuum electro-sprays and stretches into the vacuum cavity; the air pressure in the vacuum cavity is ranged from 10 to 200 Pa; one end of the gas inlet pipe stretches into the vacuum cavity, and the other end is connected with the gas supply device; and the adjusting device is configured for adjusting the gas inlet pipe to allow the gas to flow therein intermittently.

In the above vacuum electro-spray ion source, the difference between the inner and outer pressure at the sampling port and the spray is used as a driving force to enable a to-be-detected liquid sample entering the capillary to be sucked to the spray port in the vacuum cavity; meanwhile, a gas is controlled, via the adjusting device and the gas inlet pipe, to enter the vacuum cavity in an intermittent manner so as to create an instantaneous atmospheric environment, such that the spray could produce stable electro-sprays in the vacuum cavity.

In a preferred technical solution, the vacuum electro-spray ion source also comprises a three-way connector; wherein the gas inlet pipe comprises a first hollow pipe and a second hollow pipe; the second end of the hollow capillary sequentially passes through a first interface and a second interface of the three-way connector, and stretches into the vacuum cavity; an end of the first hollow pipe is connected with an end of the second hollow pipe within the three-way connector, and the other end of the first hollow pipe passes through the second interface, and stretches into the vacuum cavity; the other end of the second hollow pipe passes through a third interface of the three-way connector to be connected with the gas supply device.

In the above solution, owing to the arrangement in which the three-way connector is connected with the capillary, the first hollow pipe and the second hollow pipe, a vacuum electro-spray ion source of a compact structure could be achieved, thereby facilitating integration and portability.

Further preferably, the hollow capillary passes through an inner portion of the first hollow pipe within the three-way connector, and then, passes through the second interface at the same position with the first hollow pipe, and stretches into the vacuum cavity.

In the vacuum cavity, a port of the hollow capillary is flush with respect to a port of the first hollow pipe or spaced apart less than 1 cm from a port of the first hollow pipe. Preferably, the port of the hollow capillary is retracted by a distance of less than 1 cm with respect to the port of the first hollow pipe. As such, the liquid sample sprayed by the hollow capillary may be better immersed in the atmospheric environment created by the gas introduced from the first hollow pipe, thereby improving ionization effects.

Further preferably, the gas inlet pipe further comprises a third hollow pipe and a silica gel collapsible hose; the adjusting device comprises a pinch valve; an end of the third hollow pipe is connected with an end of the second hollow pipe within the pinch valve via the silica gel collapsible hose, and the other end of the third hollow pipe is connected with the gas supply device, wherein the pinch valve is used for controlling the circulation of gas flows between the third hollow pipe and the second hollow pipe. Owing to the arrangement of the silica gel collapsible hose and the pinch valve, the intermittent control of gas introduction could be achieved easily; moreover, pressure changes of the vacuum cavity due to gas introduction could be controlled conveniently to achieve optimal air pressure, thereby maximizing the detection intensity and the detection limit.

Further preferably, the gas supplied by the gas supply device is helium. The introduced gas may be a mixture of one or more of air, nitrogen, helium, hydrogen and argon, but it is preferred to be helium. In addition to being used for creating an instantaneous atmospheric environment, the introduced gas may also be used as buffering gas molecules to collide with ions generated by ionization. When helium is introduced, it is a gas having a relatively small molecular weight, and it may be used as buffering gas molecules to collide gently with ions. As such, no fragment is produced among electro-spray ions, which helps further improve the signal intensity.

The sampling port of the hollow capillary is directly placed in the liquid sample, wherein the liquid sample is placed in the atmospheric environment and inserted therein with electrodes loaded with high voltage power. As such, the capillary is directly placed in the sample dispenses, no need of using an injection means or an injection pump to inject the liquid sample into the system, thereby avoiding the problem of sample contamination.

The high voltage power is negative high voltage power in a range from −5,000 V to 4,000 V, or positive high voltage power in a range from 1,000 V to 5,000 V.

The technical problem faced by the embodiments of the present application is solved via a further technical solution described below:

a mass spectrometer is provided, which comprises the vacuum electro-spray ion source as described above, wherein the vacuum cavity of the vacuum electro-spray ion source is in communication with a vacuum cavity of the mass spectrometer.

Preferably, a vacuum in the vacuum cavity of the vacuum electro-spray ion source is maintained by a mechanical pump, a vacuum in the vacuum cavity of the mass spectrometer is maintained by a turbo-molecular pump and the mechanical pump is connected with the turbo-molecular pump and acts as a foreline pump of the turbo-molecular pump.

As compared with the prior art, the embodiments of the present application have the following beneficial effects:

The embodiments of the present application may achieve electro-spray ionization in the vacuum environment. Specifically, the vacuum cavity of the ion source could be in communication with that of the mass spectrometer. As such, ions could be directly driven into the vacuum cavity of the mass spectrometer by means of the guiding after the inflow of an intermittent gas. In this manner, losses of ions during transmission may be reduced, thereby improving the signal intensity and detection limit, thus avoiding the problems of losses and reduction in the signal intensity due to transmission of ions into the mass spectrometer by means of a sample introduction device. In the meanwhile, the introduction of a gas may also enhance desolvation effect on electro-sprays, thus improving the ion yield. The ion source described in the embodiments of the present application may be capable of generating electro-sprays in the vacuum environment, which avoids losses that occur in the transmission process of the electro-spray ion source under atmospheric pressure, thus helping reduce the consumption amount of samples. Meanwhile, the electro-spray ion source is of a simplified structure, which is particularly suitable for use as the ion source for the portable mass spectrometer, thus achieving real-time online detection and analysis of samples as well as their electro-spray ionization.

DETAILED DESCRIPTION

The present application will be further illustrated below in conjunction with the embodiments and with reference to the accompanying drawings.

The idea of the embodiments of the present application is as follows: achieving ionization in an atmospheric environment requires the use of a sample introduction device to transmit ions into the vacuum cavity of the mass spectrometer, which may lead to losses of ions; moreover, liquid samples may crystallize at the capillary tip if ionization directly occurs in a vacuum environment, thus defying the generation of electro-sprays. In some solutions, laser heating device, constant-pressure sample introduction device and other auxiliary means are employed for the purpose of generating electro-sprays in the vacuum environment; nevertheless, these auxiliary device are bulky and structurally complex, which are neither favorable for integration nor suitable for use in portable mass spectrometers. In the embodiments of the present application, the ion source is improved with respect to its structure. Specifically, a to-be-detected liquid sample is sucked to the spray port within the vacuum cavity via the hollow capillary; meanwhile, a gas is controlled, via the adjusting device and the gas inlet pipe, to enter the vacuum cavity in an intermittent manner so as to create an instantaneous atmospheric environment, such that electro-sprays may be directly generated within the vacuum cavity, thus reducing losses of ions during transmission.

Figure 1:
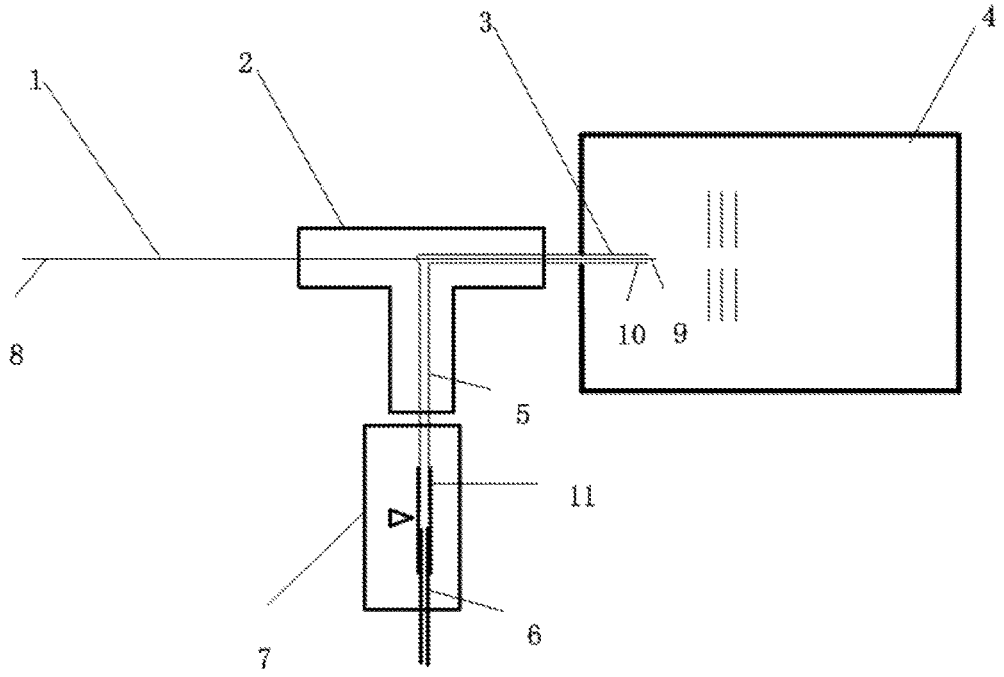
FIG. 1 is a structural schematic diagram illustrating a vacuum electro-spray ion source of the embodiments of the present application.

As shown in FIG. 1, a structural schematic diagram of a vacuum electro-spray ion source in the present embodiment is illustrated. The vacuum electro-spray ion source comprises a hollow capillary 1, a three-way connector 2, a first hollow pipe 3, a vacuum cavity 4, a second hollow pipe 5, a third hollow pipe 6, a silica gel collapsible hose 11 and a pinch valve 7.

Wherein, one end of the hollow capillary 1 acts as a sampling port 8, and the other end passes through the three-way connector 2 and acts as a spray nozzle 9 for vacuum electro-sprays. The spray nozzle 9 passes through the first hollow pipe 3, and directly stretches into the vacuum cavity 4, wherein air pressure inside the vacuum cavity is ranged from $10^{-4}$ to 200 Pa. The sampling port 8 is in the atmospheric environment or the environment whose air pressure is higher than that of the environment where the spray nozzle 9 lies. In this manner, the spray nozzle 9 and the sampling port 8 are located in the environments of different air pressure. This leads to an air pressure difference, which enables a liquid sample introduced from the sampling port to enter the vacuum cavity 4 by means of negative pressure.

An end of the first hollow pipe 3 is connected with that of the second hollow pipe 5 in the three-way connector 2, and the other end 10 of the first hollow pipe 3 passes through the second interface of the three-way connector 2, and stretches into the vacuum cavity 4. The port of the spray nozzle 9 is flush with respect to the port of the end 10, or it is retracted or protrudes out of the port of the hollow pipe 3 by a distance of 1 cm (i.e. that it is retracted or protrudes out of the port of the hollow pipe 3 by a distance of plus or minus 1 cm with respect to the flush point).

The other end of the second hollow pipe 5 is connected with the external gas supply device (not shown). Specifically, the silica gel collapsible hose 11 is connected with one end of the third hollow pipe 6 in the pinch valve 7, such that the pinch valve 7 connects the second hollow pipe 5 with the third hollow pipe 6. The switching of the pinch valve 7 may be controlled to manipulate the communication between the third hollow pipe 6 and the second hollow pipe 5. The pinch valve 7 may be controlled, such that a gas flows through the third hollow pipe 6, the second hollow pipe 5 and the first hollow pipe 3, which is then sprayed into the vacuum cavity 4 from the port 10 of the first hollow pipe 3. Moreover, as the pinch valve may be controlled, the above introduction process of the gas is intermittent. In other words, the valve is closed after the gas is introduced for a period of time; then, it is opened to allow the introduction of the gas for another period of time; after that, the valve is closed again. This process repeats again and again to achieve intermittent introduction of the gas, thereby creating an instantaneous atmospheric environment in the vacuum environment of the vacuum cavity 4.

In the above ion source, the hollow capillary 1 is a hollow glass capillary, and a liquid sample loaded with high voltage power is fed from the sampling port of the hollow capillary 1. During operation, there is an air pressure difference between two ends of the capillary 1. Driven by the pressure difference, the liquid sample is sucked into the vacuum cavity 4 via the hollow capillary 1. Under the action of the loaded high-voltage electric field, electro-sprays are generated at the spray nozzle 9. Meanwhile, the pinch valve 7 is opened intermittently, and the external air is introduced, via the third hollow pipe 6, the second hollow pipe 5 and the first hollow pipe 3, into the vacuum cavity 4 to create an instantaneous high pressure environment, namely to create an atmospheric environment, such that electro-sprays are generated at the spray nozzle 9 in the created atmospheric environment. Meanwhile, the generated electro-sprays are driven by the gas flow field into the mass analyzer of the subsequent mass spectrometer, and finally detected by the ion detector in the end.

In the present embodiment, a gas is introduced intermittently to create an atmospheric environment required for the generation of electro-sprays. In traditional solution, electro-sprays are generated in the atmospheric segment, while in the present embodiment, electro-sprays are generated in a vacuum environment. Meanwhile, the introduced gas may also play a role of auxiliary blowing, which accelerates the volatilization of solvents in spray droplets and improves desolvation effect, thus facilitating the generation of gas-phase ions. The present embodiment, as an ion source, may generate electro-sprays in the vacuum environment so as to avoid the electro-spray ion source from losses that occur in the transmission process under atmospheric pressure. As such, this ion source is particularly suitable for use in the portable mass spectrometer, thus achieving real-time online detection and analysis of samples as well as their electro-spray ionization.

Figure 2:
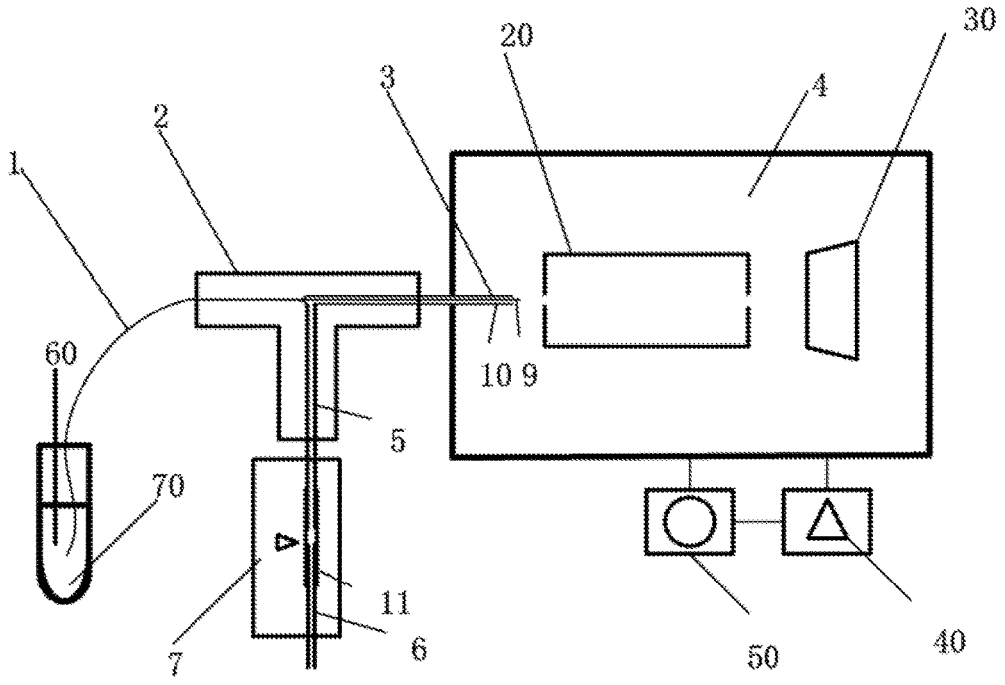
FIG. 2 is a structural schematic diagram illustrating a mass-spectrometric detection system formed by the vacuum electro-spray ion source of the embodiments of the present application.

As shown in FIG. 2, a structural schematic diagram of a mass-spectrometric detection system formed by the connection of an ion source having the above structure with a liquid storage device and a mass spectrometer that are respectively located in front of and behind the ion source is illustrated. A liquid sample 70 is placed in the atmospheric environment, and the liquid sample 70 is inserted therein with electrode 60 which is loaded with high voltage power. A hollow capillary 1 is a hollow glass capillary, one end of which is directly inserted into the liquid sample 70 to act as a sampling port. The hollow capillary 1 runs through a three-way connector 2 and a first hollow pipe 3, and stretches into a vacuum cavity 4.

The vacuum cavity 4 of the vacuum electro-spray ion source is in communication with a vacuum cavity of the mass spectrometer. Specifically, the vacuum cavity 4 is combined with the vacuum cavity of the mass spectrometer, or the vacuum cavity of the mass spectrometer is directly used as the vacuum cavity in the above ion source. In this manner, a mass analyzer 20 and an ion detector 30 of the mass spectrometer, a spray nozzle 9 of the ion source, and a port 10 are all placed within the same vacuum cavity 4. The vacuum cavity 4 is connected with a turbo-molecular pump 40 and a mechanical pump 50, wherein the turbo-molecular pump 40 is connected with the mechanical pump 50. During operation, the turbo-molecular pump 40 cooperates with the mechanical pump 50 to keep the air pressure of the vacuum cavity 4 in a range from $10^{-4}$ to 200 Pa.

During operation of the system, there is an air pressure difference between two ends of the hollow capillary 1, and the powered liquid sample 70 is directly sucked into the hollow capillary, and then is sucked into the vacuum cavity 4. Meanwhile, a pinch valve 7 is opened instantaneously, and an external gas is introduced into the vacuum cavity 4 through the hollow pipe 6, the hollow pipe 5 and the hollow pipe 3. Under the actions of the instantaneous high pressure environment and the high-voltage electric field formed by powering, electro-sprays are generated at the spray nozzle port 9. Moreover, the introduced external gas may also facilitate desolvation of the electro-sprays, and assist in forming electro-sprays to further improve the ion yield. Driven by the introduced gas flow, gas-phase ions generated by electro-sprays may be driven to directly enter the vacuum environment of the mass spectrometer, and then enter the mass analyzer 20, and is finally detected by the ion detector 30.

The ion source of the present embodiment may be capable of generating stable electro-sprays in the vacuum environment. As these electro-sprays are directly generated in the vacuum environment, they can be directly transmitted into the mass spectrometer, which reduces losses of ions during transmission and improves the signal intensity and detection limit. In this manner, there is no need to employ a transmitting device, which, in turn, simplifies the structure of the electro-spray ion source, thus helping reduce the consumption amount of samples. Furthermore, in addition to providing instantaneous high pressure required by the generation of electro-sprays in a vacuum environment, the introduced gas may also accelerate the volatilization of solvents in spray droplets and improve desolvation effect, thus facilitating the generation of gas-phase ions and improving the ion yield. This ion source cooperates with the mass spectrometer to constitute the detection system, and both the signal intensity and the detection limit are improved during detection. The ion source is particularly suitable for use in the portable mass spectrometer, which may have an advantage of a small consumption amount of samples and may achieve real-time online analysis and detection on the spot.

The above contents are provided to further illustrate the present application in conjunction with the preferred embodiments, and it should not be determined that the implementation of the present application is merely limited thereto. For those of ordinary skill in the art, several substitutions or obvious modifications, which are made without departing from the concept of the present application and whose functions or uses are identical, should be considered to be covered by the scope of protection of the present application.

The invention claimed is:

1. A vacuum electro-spray ion source, comprising:

a hollow capillary, a vacuum cavity, a gas inlet pipe, a gas supply device an adjusting device; and a three-way connector, wherein a first end of the hollow capillary is a sampling port, and a second end is used as a spray nozzle for vacuum electro-sprays and stretches into the vacuum cavity; the air pressure in the vacuum cavity is within a range of $10^{-4}$ to 200 Pa; one end of the gas inlet pipe stretches into the vacuum cavity, and the other end is connected with the gas supply device; and the adjusting device is configured for adjusting the gas inlet pipe to allow the gas to flow therein intermittently, wherein the gas inlet pipe comprises a first hollow pipe and a second hollow pipe; the second end of the hollow capillary sequentially passes through a first interface and a second interface of the three-way connector, and stretches into the vacuum cavity; an end of the first hollow pipe is connected with an end of the second hollow pipe within the three-way connector, and the other end of the first hollow pipe passes through the second interface, and stretches into the vacuum cavity; the other end of the second hollow pipe passes through a third interface of the three-way connector to be connected with the gas supply device, and wherein the gas inlet pipe further comprises a third hollow pipe and a silica gel collapsible hose; the adjusting device comprises a pinch valve; an end of the third hollow pipe is connected with an end of the second hollow pipe within the pinch valve via the silica gel collapsible hose, and the other end of the third hollow pipe is connected with the gas supply device, wherein the pinch valve is used for controlling the circulation of gas flows between the third hollow pipe and the second hollow pipe.

2. The vacuum electro-spray ion source of claim 1, wherein the hollow capillary passes through an inner portion of the first hollow pipe within the three-way connector, and then, passes through the second interface at the same position with the first hollow pipe, and stretches into the vacuum cavity.

3. The vacuum electro-spray ion source of claim 2, wherein, in the vacuum cavity, a port of the hollow capillary is flush with respect to a port of the first hollow pipe or spaced apart less than 1 cm from a port of the first hollow pipe.

4. The vacuum electro-spray ion source of claim 1, wherein a gas supplied by the gas supply device is helium.

5. The vacuum electro-spray ion source of claim 1, wherein the sampling port of the hollow capillary is directly placed in a liquid sample, wherein the liquid sample is placed in an atmospheric environment and inserted therein with an electrode which is loaded with high voltage power.

6. The vacuum electro-spray ion source of claim 5, wherein the high voltage power is negative high voltage power in a range from −5,000 V to −1,000 V, or positive high voltage power in a range from 1,000 V to 5,000 V.

7. A mass spectrometer, comprising the vacuum electro-spray ion source of claim 1, wherein the vacuum cavity of the vacuum electro-spray ion source is in communication with a vacuum cavity of the mass spectrometer.

8. The mass spectrometer of claim 7, wherein a vacuum in the vacuum cavity of the vacuum electro-spray ion source is maintained by a mechanical pump, a vacuum in the vacuum cavity of the mass spectrometer is maintained by a turbo-molecular pump, and the mechanical pump is connected with the turbo-molecular pump and acts as a foreline pump of the turbo-molecular pump.

* * * * *